United States Patent [19]

Aubrey

[11] Patent Number: 4,683,402

[45] Date of Patent: Jul. 28, 1987

[54] ADAPTORS FOR FLUORESCENT LAMPS

[76] Inventor: Truman Aubrey, 1472 Beaudry Blvd., Glendale, Calif. 91208

[21] Appl. No.: 727,300

[22] Filed: Apr. 25, 1985

[51] Int. Cl.[4] ..... H01J 17/34; H01J 7/44

[52] U.S. Cl. ..... 315/56; 315/58; 315/71; 313/318; 336/96; 439/236

[58] Field of Search ..... 315/56, 57, 70, 71; 313/493, 318; 339/54, 55, 76, 145 T, 176 L; 336/90, 107; 362/437

[56] References Cited

U.S. PATENT DOCUMENTS

| | | | |
|---|---|---|---|
| Re. 18,798 | 4/1933 | von Wedel | 315/57 |
| 113,357 | 11/1938 | Babb | 182/70 |
| 1,348,394 | 8/1920 | Douglas | 339/171 |
| 1,640,434 | 8/1927 | Weston | 339/167 |
| 1,963,961 | 6/1934 | Barclay | 315/57 |
| 2,247,006 | 6/1941 | Whitmore | 339/66 R |
| 2,298,961 | 10/1942 | Miller | 315/276 |
| 2,422,222 | 6/1947 | Carroll | 339/168 |
| 2,505,993 | 5/1950 | Rogers | 315/58 |
| 2,525,022 | 10/1950 | Dupuy | 362/216 |
| 3,551,736 | 12/1970 | Doehner | 315/100 |
| 3,815,080 | 6/1974 | Summa | 339/52 R |
| 4,022,635 | 5/1977 | Earing | 252/572 |
| 4,208,604 | 6/1980 | Couwenberg | 313/113 |
| 4,225,905 | 9/1980 | Moriyama et al. | 362/216 |
| 4,258,287 | 3/1981 | Hetzel | 315/58 |
| 4,316,120 | 2/1982 | Cotman et al. | 315/58 |
| 4,326,149 | 4/1982 | Wyner et al. | 315/289 |
| 4,334,172 | 6/1982 | Wyner et al. | 315/289 |
| 4,337,414 | 6/1982 | Young | 315/56 |
| 4,347,460 | 8/1982 | Latassa et al. | 315/63 |
| 4,375,607 | 3/1983 | Morton et al. | 315/56 |
| 4,383,200 | 5/1983 | Van Zon et al. | 315/57 |
| 4,414,489 | 11/1983 | Young | 315/57 |
| 4,443,778 | 4/1984 | Mewissen | 315/70 |
| 4,495,443 | 1/1985 | Cummings | 315/58 |
| 4,570,105 | 2/1986 | Engel | 315/71 |

*Primary Examiner*—Leo H. Boudreau
*Assistant Examiner*—Theodore Salindong
*Attorney, Agent, or Firm*—Fulwider, Patton, Rieber, Lee & Utecht

[57] ABSTRACT

An improved adaptor for using fluorescent lighting in fixtures designed for incandescent lamps which comprises a housing having a centrally located lined cavity which depends through the housing and which is adapted to receive the starter element, a mounting means or plug which depends from the lower surface of the housing, and ballast disposed within the interior of the housing adjacent to or about the lined cavity which depends through the central portion of the housing.

9 Claims, 6 Drawing Figures

ADAPTORS FOR FLUORESCENT LAMPS

BACKGROUND OF THE INVENTION

This invention generally relates to an adaptor which facilitates use of fluorescent lamps in light fixtures designed for incandescent lamps.

Fluorescent lighting is well known to be more energy efficient than incandescent lighting of equivalent output. The increases in energy costs over the last decade have provided a significant incentive to convert the existing incandescent lighting to fluorescent lighting, but unfortunately in many instances the conversion costs have been prohibitively high.

Small fluorescent bulbs have become available and adaptors have been developed which enable use of such small fluorescent bulbs in sockets designed for incandescent lighting. However, the adaptors developed were relatively large because of the need for ballast when using fluorescent lamps, and on occasions the fluorescent lamp would extend outwardly so far that the lamp fixture in which the fluorescent lamp was installed would have to be modified significantly in order to mount a decorative cover. These adaptors were for the most part aesthetically very unattractive and usually their use was limited to those situations where the adaptor was completely covered or otherwise unseen.

Efforts have been made to develop adaptors which would reduce the outward extension of fluorescent lamps when using such adaptors, but such developments have not been completely successful. For example, in U.S. Pat. No. 4,495,443 (Cummings), an adaptor is described having a screw plug in which the starter housing of the fluorescent lamp is seated therein so that the distance between the tip of the fluorescent lamp and the opposite end of the screw plug is substantially reduced. However, with the particular structure described, the ballast required by the fluorescent lamp was provided in an exterior housing which extended parallel to the light bulb and this made the entire lamp assembly very cumbersome to screw into existing incandescent sockets and, moreover, made the mounting of decorative covers difficult and, in some situations, impossible without significant modifications to the light fixture. Additionally, the adaptor was unsightly and was not acceptable for use in installations where it would be seen.

Thus, it is evident that the need remains for an easily installed, aesthetically pleasing adaptor that facilitates the use of fluorescent lamps in incandescent light sockets which do not require significant modifications to the light fixture to mount a decorative cover. The present invention satisfies this need.

SUMMARY OF THE INVENTION

The present invention relates to an improved adaptor for the utilization of fluorescent light bulbs or lamps in light fixtures designed for incandescent light bulbs.

The fluorescent lamp base adaptor, in accordance with the invention, comprises a housing having a mounting plug which depends from the lower surface thereof and which is provided with a threaded metallic means to facilitate screwing the adaptor into a light fixture designed for incandescent lighting. A lined cavity, which is adapted to receive the starter housing of a fluorescent lamp, is integrally formed in the upper surface of the housing and small sockets are provided within the cavity to receive the metallic pin electrodes of fluorescent lamps. One or more coils and cores are provided as ballast within the interior of the housing which are electrically connected to the pin sockets and a threaded metallic cover on the mounting plug or lead wires from the fixture.

The coils and core within the adaptor housing which form the ballast are disposed adjacent to or about the lined cavity which depends from the upper surface of the housing through the central portion thereof so that, when the starter housing of the fluorescent lamp is inserted into the cavity, the lower surface thereof is disposed well into the mounting plug.

It is preferred to fill the interior of the housing with a potting compound such as tar and sand which remains solid during the operation of the lamp. The hardened potting compound supports the ballast and minimizes heat build-up when the adaptor is in use. The adaptor can be used at rated capacity.

The lamp base converter of the invention is easily screwed into existing sockets adapted for incandescent lighting or attached to the fixture wires and, moreover, because of the shortness of the housing and the disposition therein of the ballast, there is little or no interference with the mounting of decorative covers onto the light fixture when utilizing the adaptor base. Moreover, because the lined cavity adapted to receive the starter element of the fluorescent lamp is formed integrally with the upper surface of the base housing, there is no hazardous wiring exposed when the fluorescent lamp is removed from the adaptor.

These and other advantages of the invention will become more apparent from the following detailed description when taken in conjunction with the accompanying exemplary drawings.

BRIEF DESCRIPTION OF THE INVENTION

DETAILED DESCRIPTION OF THE INVENTION

Figure 1:
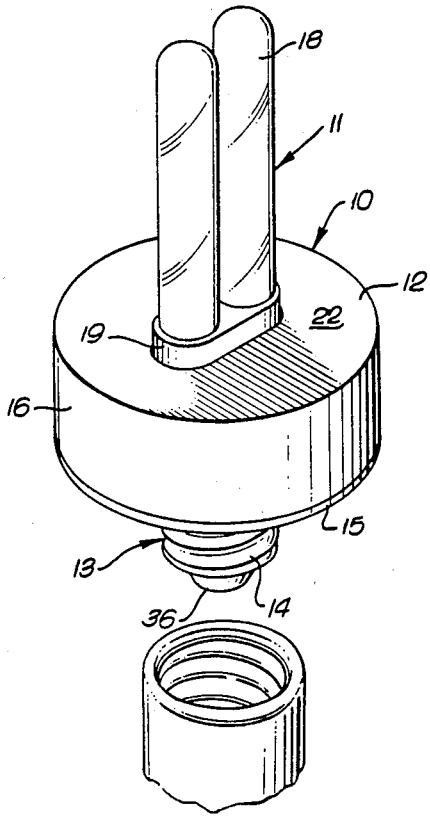
FIG. 1 is a perspective view of an adaptor and fluorescent lamp which illustrate embodiments of the invention.
Figure 2:
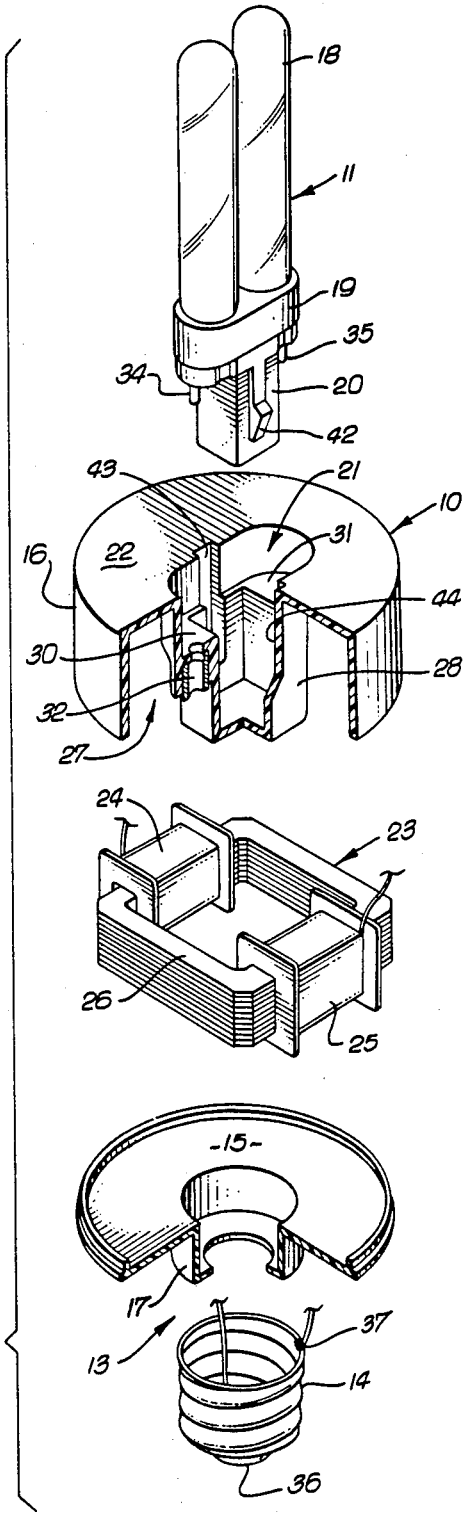
FIG. 2 is an exploded perspective view, partially in section, of the adaptor and fluorescent lamp shown in FIG. 1.

Reference is made to FIG. 1 which illustrates an adaptor 10, which embodies features of the invention, and a fluorescent lamp 11 mounted therein, and to FIG. 2 wherein the adaptor 10 is shown in an exploded perspective view with a fluorescent lamp 11.

As illustrated in FIGS. 1–4, the adaptor 10 comprises a housing 12 and a depending mounting means 13 provided with a metallic threaded cover 14 which facilitates screwing the adaptor 10 into a socket designed for conventional incadescent lamps. The mounting plug 13 depends from lower closing plate 15 which snap fits into engagement with the bottom of cylindrical wall section 16. The metallic cover 14 is mounted onto the extension 17 which depends from the closing plate 15. The fluorescent lamp 11 comprises a bulb portion 18, a base 19, and a starter section 20 depending from the base 19 which is seated within the lined cavity 21 provided in the upper surface 22 of the adaptor housing 12. The centrally disposed cavity 21 depends from the upper surface 22 through the housing 12 and into the interior of the mounting means 13.

The ballast 23, comprising coils 24 and 25 and a core 26, is disposed within the interior 27 of the housing 12 and surrounds the lined cavity 21 which is adapted to accept the starter section 20 of the fluorescent lamp 11.

The lined cavity 21 is provided with shoulders 30 and 31 on each side of the cavity lining 28 having sockets 32 and 33 adapted to receive the metal pin electrodes 34 and 35 which depend from the base 19 of the fluorescent lamp 11. Socket 32 is electrically connected to the electrical contact button 36 and socket 33 is connected to one of the coils 24. The other electrical contact 37 on the metallic threaded cover 14 is electrically connected to the remaining coil 25.

Figure 3:
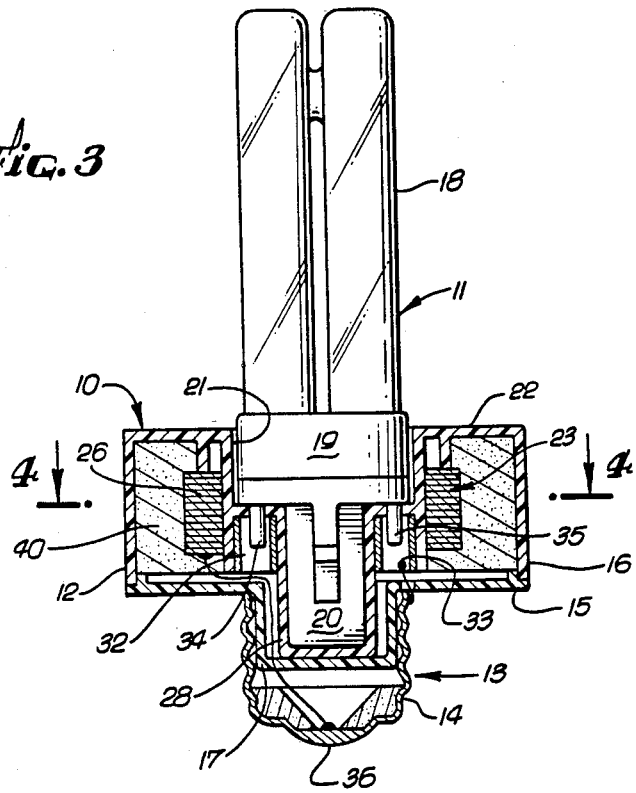
FIG. 3 is a cross-sectional elevational view of the adaptor and lamp shown in FIGS. 1 and 2.
Figure 4:
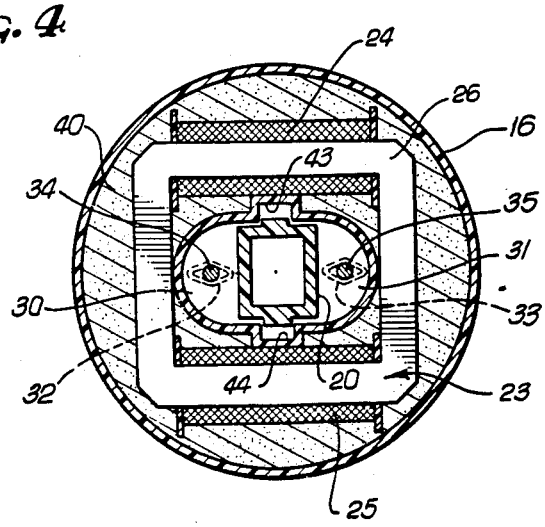
FIG. 4 is a transverse, cross-sectional view taken along the lines of 4—4 shown in FIG. 3.

As shown in FIGS. 3 and 4, the interior of the housing 12 is preferably filled with a potting compound such as a tar and sand mixture 40 which remains solid at the operating temperature the adaptor 10. This potting material 40 not only provides support for the coils 24 and 25 and the core 26, but it also helps dissipate heat generated during the use of the adaptor 10. It has been found that adaptor designs in accordance with the present invention operate from about 5° to 20° F. cooler than existing adaptors.

The housing 12 as shown in the drawings is generally cylindrical in shape, having a circular transverse cross-section. However, it should be recognized that other transverse shapes are suitable. For example, the transverse cross-section can be polygonal in nature, having four or more sides. Additionally, other modifications can be made to the overall shape of the adaptor to aid in the remounting of decorative lamp covers to the light fixture.

The inner dimensions of the cavity 21 provided in the upper surface 22 of the adaptor 10 are designed so that the starter element 20 of the fluorescent lamp 11 can be easily inserted therein. The starter element 20 of fluorescent light 11 is provided with protuberances 41 and 42 on opposing sides thereof which slide in elongated recesses 43 and 44 provided in the cavity lining 28 so that the depending pin electrodes 34 and 35 of the fluorescent lamp 11 are guided into the sockets 32 and 33 provided in the shoulders 30 and 31 within the cavity 21. The cavity lining 28 generally is long enough to depend into section 17 which forms part of the mounting plug 13. The pin electrodes 34 and 35 are adapted to snugly fit into the sockets 32 and 33 so that in those instances wherein the fluorescent lamp 11 and adaptor 10 must be screwed upwardly into an existing incandescent lamp socket, the fluorescent lamp 11 will not become loose or disengaged from the adaptor 10.

As is evident from the above discussion, the adaptor of the invention can be readily installed into existing sockets designed for incandescent lighting. The housing element is relatively short in comparison to its width so that the fluorescent lamp, when installed, does not extend outwardly to such a distance that it precludes use of the adaptor in a large number of applications. Preferably, the ratio of width to height exceeds 2. Moreover, because the ballast is conveniently disposed within the adaptor housing about the cavity adapted to accept the starter element of the fluorescent light, there usually is no need to modify the light fixture in order to remount a decorative lamp cover onto the fixture when using the adaptor of the invention.

Figure 5:
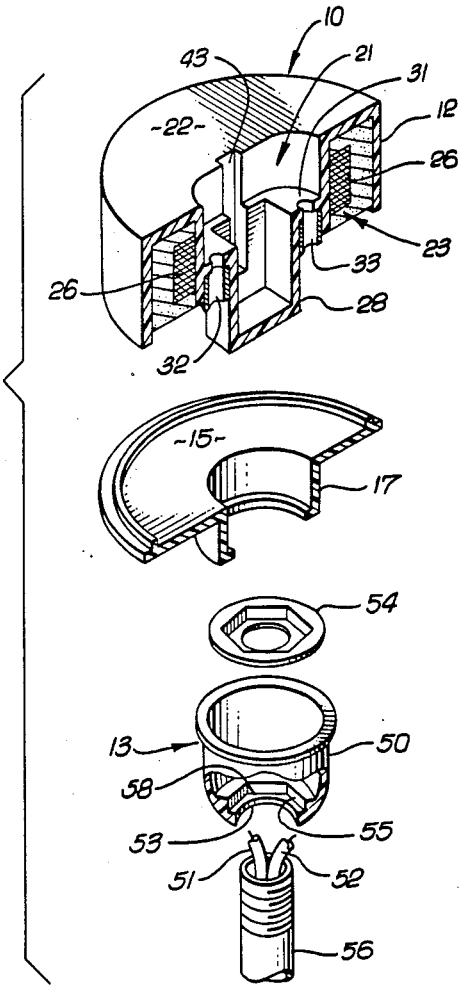
FIG. 5 is a perspective view of another embodiment of the invention.
Figure 6:
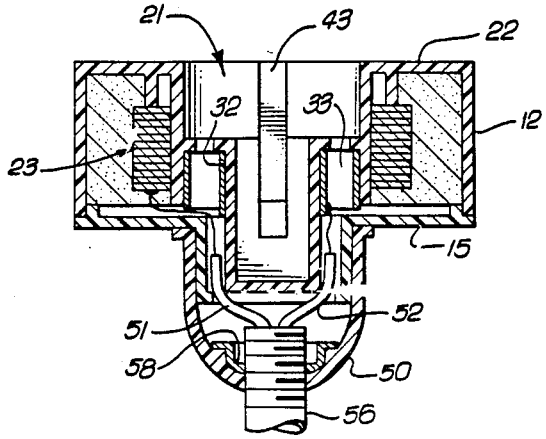
FIG. 6 is a cross-sectional view of the embodiment shown in FIG. 5. In the drawings all corresponding parts are numbered the same.

FIG. 5 illustrates another embodiment of the invention which is directed to an adaptor suitable for direct electrical and physical connection to a light fixture. In this particular embodiment the housing 12 and the ballast 23 are as shown in FIGS. 1–4. However, a cap 50 is provided to fit over the depending section 17 of the mounting means 13. Insulated conductors 51 and 52 electrically connected to the pin socket 33 and the coil 25, respectively, pass through the opening 53 provided in cap 50. Threaded connecting element 54 is provided to fit into the seat 58 on the inside of cap 50 and axially aligned with the opening 53. Threaded nipple 56 is engaged with the connecting element 54 and is mountable onto a threaded mating element of a light fixture (not shown). This construction allows the use of fluorescent lamps without the necessity for the incandescent socket because of the direct connection of the leads 51 and 52 to an electrical power source.

The adaptor of the invention is sufficiently attractive so that lamp covers can be attached directly to the adaptor. A suitable mounting bracket can be fixed to the upper surface of the adaptor which can engage the lip of a lamp cover in a conventional manner. Other mounting elements can be employed in different situations. For example, a bracket might be fixed to the top of the adaptor having a threaded connection to facilitate connecting a reflectorized flood lamp cover to the adaptor.

The adaptor of the invention can be utilized in a wide variety of installations, both indoor and outdoor. Moreover, the adaptor is aesthetically pleasing and can be readily decorated to match or to be otherwise compatible with various decorative covers. It is obvious that various modifications and and improvements can be made to the present invention without departing from the scope thereof.

I claim:

1. An adaptor which facilitates the installation into a light fixture designed for conventional incandescent light bulbs of a fluorescent lamp having an elongated bulb portion, a base and depending from the base a starter portion and a pair of pin electrodes on opposite sides of the starter portion comprising:

a. housing having a centrally disposed passageway which passes through the housing;

b. mounting means depending from the underside of the housing for mounting the adaptor to a light fixture for conventional incandescent light bulbs, said mounting means having a receiving chamber therein which is in alignment with the centrally disposed passageway through the housing;

c. ballast means disposed within the housing having a central passageway therethrough which is coaxial with the centrally disposed passageway through the housing;

d. a socket defined in part by said centrally disposed passageway through the housing and a receiving chamber of the mounting means which allows the starter portion of the fluorescent lamp to extend into the receiving mounting means.

2. The adaptor of claim 1 wherein the housing is filled with a potting compound.

3. The adaptor of claim 2 wherein the potting compound is a mixture of sand and tar which remains solid at the operational temperatures of the lamp base.

4. The adaptor of claim 1 wherein the socket depending through the housing and into the mounting means is lined and is provided with opposing shoulders having individual sockets adapted to receive pin electrodes provided on the base of the fluorescent lamp.

5. The adaptor of claim 4 wherein the lined socket depending through the housing is provided with vertically oriented, opposing elongated recesses adapted to receive protuberances on opposing sides of the starting element of the fluorescent lamp and to thereby position the lamp within the lined socket.

6. The adaptor of claim 1 wherein the ballast comprises opposig coils disposed on opposite sides of the central passageway therethrough and interconnected by means of a core element surrounding the central passageway.

7. The adaptor of claim 1 wherein the mounting means has a theaded element for connection to the light fixture.

8. The adaptor of claim 7 wherein the threaded element is a metallic cover on the outside of the mounting means which is adapted to be screwed into an incandescent lamp socket having mating threads.

9. The adaptor of claim 7 wherein the mounting means has a threaded aperture which is adapted to be screwed onto a threaded nipple.

* * * * *